United States Patent [19]

Harvey et al.

[11] Patent Number: 4,758,244

[45] Date of Patent: Jul. 19, 1988

[54] UPGRADING SOLID FUELS

[75] Inventors: Kay F. Harvey; Theodore V. Verheyen; Reginald B. Johns, all of Victoria; Alan L. Chaffee, Illawong; Alan S. Buchanan; David A. Cain, both of Victoria, all of Australia

[73] Assignees: University of Melbourne; CRA Services Limited, Victoria, Australia

[21] Appl. No.: 939,027

[22] Filed: Dec. 8, 1986

Related U.S. Application Data

[63] Continuation-in-part of Ser. No. 580,260, Feb. 15, 1984, Pat. No. 4,627,575, and a continuation-in-part of Ser. No. 824,676, Jan. 31, 1986, abandoned.

[30] Foreign Application Priority Data

Feb. 17, 1983 [AU] Australia ..... PF8078
Feb. 1, 1985 [AU] Australia ..... PG9107

[51] Int. Cl.[4] ..... C10L 5/12

[52] U.S. Cl. ..... 44/608; 44/15 R; 44/16 R; 44/26; 44/592

[58] Field of Search ..... 44/1 G, 10 D, 15 R, 44/25, 26, 16 R

[56] References Cited

U.S. PATENT DOCUMENTS

| | | | |
|---|---|---|---|
| 2,009,463 | 7/1935 | Windecker | 44/15 R |
| 2,567,136 | 9/1951 | Vloeberghs | 44/25 |
| 2,652,354 | 9/1953 | Dryden et al. | 44/15 R |
| 4,083,697 | 4/1978 | Smith et al. | 44/25 |
| 4,226,601 | 10/1980 | Smith | 44/10 D |

FOREIGN PATENT DOCUMENTS

| | | | |
|---|---|---|---|
| 24294/84 | 8/1984 | Australia . | |
| 26116 | 8/1968 | Japan | 44/15 R |
| 8453 | 10/1968 | Japan | 44/15 R |
| 131288 | 8/1982 | Japan | 44/15 R |
| 170275 | 9/1921 | United Kingdom | 44/10 D |
| 566001 | 12/1944 | United Kingdom | 44/15 R |

*Primary Examiner*—Carl F. Dees
*Attorney, Agent, or Firm*—Larson and Taylor

[57] ABSTRACT

Densified coal pellets of improved physical properties and enhanced calorific value are produced by a process which includes subjecting coal to a shearing-attritioning step followed by extrusion and drying steps, characterised by incorporating an additive into the coal that is subject to the said shearing-attritioning step, said additive being chosen from one or more of the group consisting of: alkali metal hydroxides, alkaline earth metal hydroxides, ammonium hydroxide, alkali metal carbonates, alkaline earth carbonates, oxides of base metals, oxides of transition metals, and small molecule carbonyl compounds.

16 Claims, 2 Drawing Sheets

UPGRADING SOLID FUELS

Figure 1:
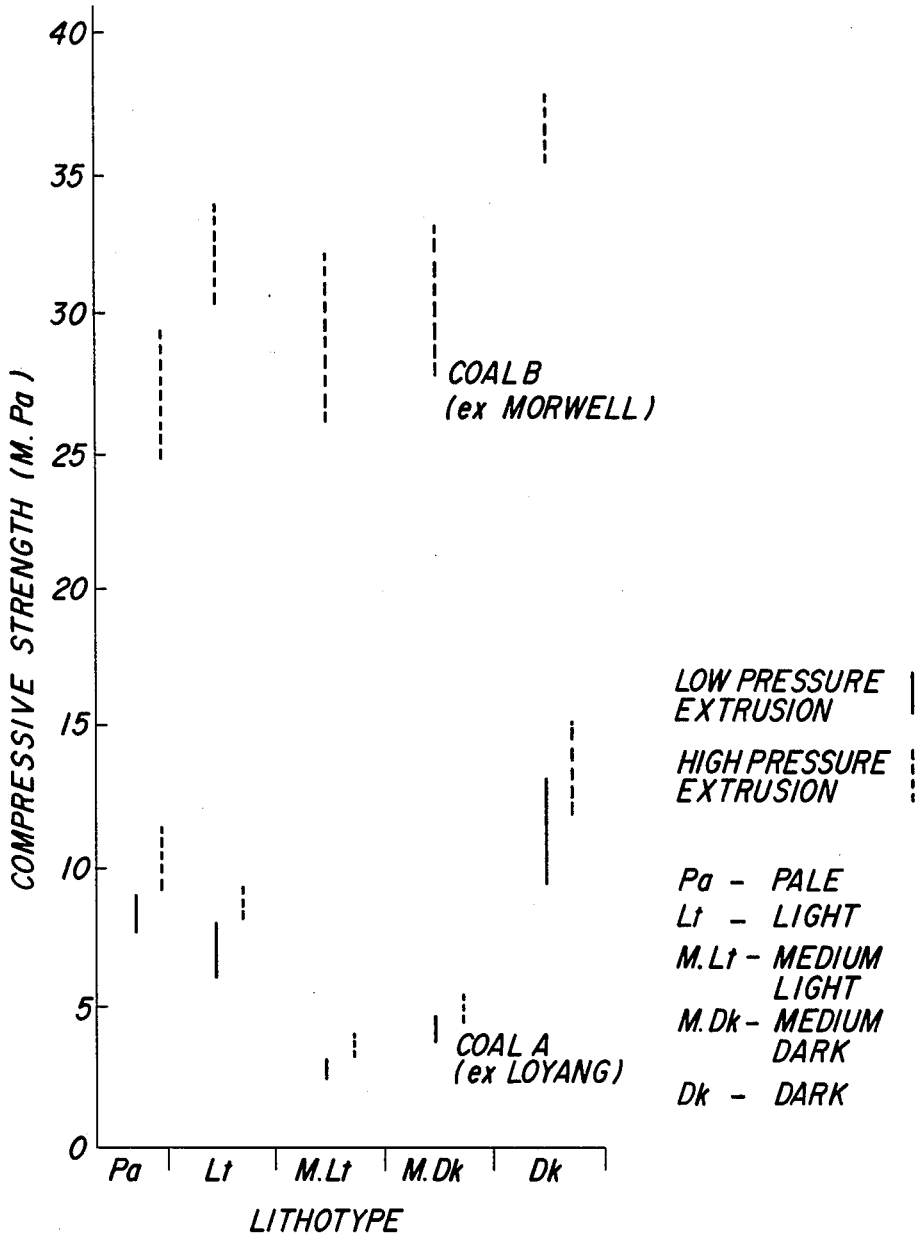

This application is a continuation-in-part of co-pending application Ser. No. 580,260, filed Feb. 15, 1984, now U.S. Pat. No. 4,627,575, and a continuation-in-part of co-pending application Ser. No. 824,676, filed Jan. 31, 1986, now abandoned, the disclosures of which are incorporated by reference herein.

This invention relates to a process for upgrading brown coal.

Brown coals as mined usually have a total moisture content greater than 60%, and in the raw state are soft, friable, low-density materials constituting a very low grade fuel.

This invention provides a process for the conversion of brown coals to hard, relatively dense solid form of fuel of much smaller residual water content and substantially enhanced calorific value per unit weight.

It has important advantages over existing briquetting and solar drying processes for upgrading brown coal. As stated, raw coal frequently has a water content in excess of 60% and its calorific value is accordingly low. By contrast with conventional briquetting no introduced thermal energy is required for removal of this water in our process. By contrast with the solar drying process no additional water is required for the attritioning of 'as mined' coal, the time required for attritioning is reduced from about 16 hours to 3–5 hours and the final drying step takes place over 3–5 days instead of several months (depending on weather conditions). The alternative processes are thus seen to be relatively inefficient and may even be uneconomic.

By comparison with the process involving solar drying the invention (as will be evident from the details set out below) has the additional advantage of reducing the processing times required, with a consequent reduction in size of the operating plant.

Among existing processes briquetting represents a widely used and long established technology to convert brown coal into a hard fuel of higher calorific value. Procedures generally involve drying the raw coal (with an 'as mined' water content generally in excess of 55%) by the application of thermal energy. A water content of 18% is usually sought as an optimum for subsequent briquetting. The dried coal is pressed after cooling to a temperature of 40°–50° C. in an extrusion press or roll briquetting machine.

In this process much thermal energy is required to dry the coal and considerable mechanical work with associated wear is involved in the briquetting operation. As a consequence the briquettes, although they are a high quality fuel, are correspondingly expensive to manufacture.

In recent times solar drying of brown coal to produce a hard product having a water content of the order of 5–10% has been proposed. In this process raw brown coal with 20–25% added water is milled in a ball mill for periods of up to 16 hours. The thixotropic slurry so produced is then exposed in shallow ponds to lose water with solar assistance. During the drying the slurry becomes hard, dark in appearance and resistant to water (that is, the solid is not substantially degraded when contacted with liquid water). The time of drying varies with the weather but may well occupy several months. This process yields a reasonably satisfactory product which may be somewhat variable in quality. It is prolonged both in respect of milling time and exposure of the slurry in solar ponds. The lengthy milling is, of course, energy intensive.

Certain aspects of the invention are illustrated in the accompanying FIGS. 1 and 2, which will be referred to in more detail below.

In a preferred aspect the present invention provides a three-step process involving comminution or attritioning, compaction and drying.

In the attritioning step the coal is subjected principally to shearing, as distinct from grinding, forces. This is accomplished by attritioning in a blending or kneading apparatus or any other machine able to efficiently comminute soft materials by shearing rather than by crushing or abrading.

As mentioned above, the solar drying process employs prolonged grinding in a ball mill. Although we do not wish to be limited by any postulated or theoretical mechanism for the observed beneficial effects of the present invention, we believe it is significant that in the first step of our process the primary fine structure of the coal is comminuted by shearing rather than grinding. Attritioning times may be as short as 1–1½ hours compared with the milling period of up to 16 hours employed in the solar-drying process and energy expenditure is accordingly greatly reduced. The product of this step is a wet, plastic mass. Little or no additional water is required during attritioning, the natural water content of the coal normally being sufficient. Subsequent removal of water is therefore minimised.

In the second step of our process the wet plastic mass of the comminuted coal is compacted, for example, by extrusion into pellets through an extruding or similar compacting device. This has the advantage of giving a product in a very convenient form for efficient drying and for handling. Compaction also appears to force the particles of the slurry into closer proximity with consequent improvement in bonding and coherence.

In the third step of our process the extruded pellets are dried, preferably at or near ambient temperature, with preferably a sufficient air flow to assist in the removal of evolved water vapour. (See FIG. 2 for changes in various properties on drying). In this manner, control of the rate of loss of water and of the temperature ensures that bonding throughout the pellet is uniform and there are no zones of weakness arising from non-uniform shrinkage. Crush strength of the resultant pellets when dry is high and often exceeds that of conventional briquettes. By contrast the solar drying process frequently results in considerable shrinkage cracking and zones of weakness with relatively poor physical performance of the final product.

The experimental information accumulated during the course of our studies of the densification of brown coal leads us to believe that definite chemical bonding is established to link together coal fragments produced by attritioning so that the final material is substantially isotropic in properties and is uniformly hard throughout. Linking together faces of adjacent coal fragments by bridge bonding provides a powerful shrinking mechanism.

As detailed below, we believe that the bridge bonding between coal faces depends on the exposure in freshly cleaved surfaces of highly reactive phenolic species which while attached by chemical bonds to the matrix of the coal polymer structure, have still the capacity to form one or more new chemical bonds to small bridging molecules which span the gaps between coal particles.

It is believed that the surfaces should be freshly formed and in close proximity since reactive species are likely to be lost over time in non-bridging reactions. A high concentration of reactive species in the original coal is clearly advantageous as is a high concentration in the system of small molecules able to form bridging structures.

Whilst the present view of the densification reaction does not require any of the coal solids to dissolve in the aqueous medium developed in the plastic mass, this medium is nevertheless essential in facilitating the formation of the bridge bonding in which a small molecule such as carbon dioxide in solution in the water forms chemical bonds to reactive points on each of the adjacent coal faces. In general it is true that additives, beneficial in the densification process, are solutes in the aqueous phase in which the coal particles are dispersed.

In terms of the above hypothesis good densification bonding requires a high concentration of reactive phenolic species as part of the coal structure and will therefore vary in efficiency with the origin of the coal and with the lithotypes in each coal deposit.

The following observations, amongst others, have led to the development of the hypothesis on the bonding mechanism.

(1) Consistent and major variations in strength of the densified coal have been observed with lithotype variation from one coal deposit and with coals from various deposits indicating constitutional differences critical in the bonding mechanism. (Refer FIG. 1).

(2) The irreversible character of the densification process and the resistance of the product to the action of water indicates that covalent bond formation rather than physical interaction between coal particles is responsible for the transformation. The susceptibility of the densified product to solvent extraction is much reduced and the nature of the extract is changed as are the high temperature pyrolysis volatiles. These observations are also indicative of strong covalent bonding between the coal particles.

(3) The observations point to the participation in the bonding process of molecular species in the coal structure with a natural acid ionisation—typically phenols and/or carboxylic acids. The reactivity of covalent bonds in such species is generally dependent on the state of ionisation of the acidic groups which is diminished by increasing acidity of the medium and vice-versa.

(4) Sodium carbonate when added to the aqueous phase during plasticisation greatly increases the strength of the densified product especially for those coals which alone yield relatively weak products (see below).

| Crush Strength of Coal Pellets Without and With 0.4% $Na_2CO_3$ Additive | | |
|---|---|---|
| | Without | With |
| | MPa | |
| Loy Yang coal | 2.8 ± 0.4 | 7.9 ± 0.3 |
| Madingley coal | 24.3 ± 2.8 | 37.7 ± 2.0 |

The effect is not one of pH only since sodium hydroxide addition has small beneficial effect. The carbonate ion (or carbon dioxide in solution) appears to play a vital role in bonding.

(5) Finely divided magnesium carbonate is also very effective as an additive in spite of its comparative insolubility. In this case both magnesium and carbonate ions appear to be involved. Calcium carbonate and/or magnesium carbonate are also effective additives for enhancing pellet strength.

| Crush Strength of Madingley Coal Pellets Without and With 5% added Fine Magnesite | |
|---|---|
| MPa | |
| 24.3 ± 2.8 | 37.2 ± 2.0 |

Urea in small concentrations improves bonding strength appreciably and this is particularly useful for those coals which normally densify less effectively. For example Loy Yang medium dark coal displays a crush strength of 5.3±0.5 MPa with no additive and this increases to 8.6±1.7 MPa with 5% added urea—an increase of 62% on the original value. The beneficial effect of organic additives appears to be confined to small carbonyl type molecules; many others tested had adverse effects.

(7) The extent of size reduction determined the strength of the densified product, maximum strength being exhibited only when attritioning is continued beyond the stage of first plasticisation (see below).

| Crush Strengths of Pellets made from Narracan Coal | | | |
|---|---|---|---|
| Time of kneading (hrs) | 3 | 4 | 5 |
| Crush strength MPa | 19.0 ± 3.5 | 30.0 ± 2.2 | 35.8 ± 1.8 |

Small particles and many freshly cleaved surfaces are thus of major importance. Higher extrusion pressures appear to be significantly beneficial indicating the importance of close contact of the attritioned coal particles for good bonding. (See FIG. 1).

The above observations strongly suggest that reactive molecular species in the freshly exposed coal surfaces are involved in forming bridging covalent bonds between coal particles. Polyhydroxyphenols especially those with meta arrangement of the hydroxyl group (resorcinol, phloroglucinol), have the requisite low temperature reactivity towards electrophilic substitution reactions. The reactivity is pH dependent and increases as the pH rises with conversion of the phenolic hydroxyls to ionic form. The polyhydroxyphenols are able to react with carbon dioxide with this molecule functioning as a simple carbonyl compound in substituting in the aromatic ring. Reaction with formaldehyde occurs in a similar manner.

When coal surfaces containing polyhydroxyphenols attached to the coal molecular skeleton are in close proximity and in an aqueous medium, bridge bonding by the carbonyl compound becomes feasible and offers an effective bonding mechanism to explain the observed characteristics of the process.

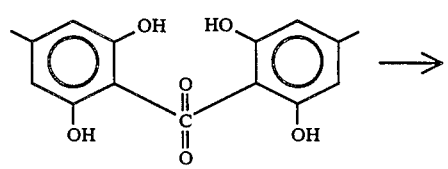

-continued

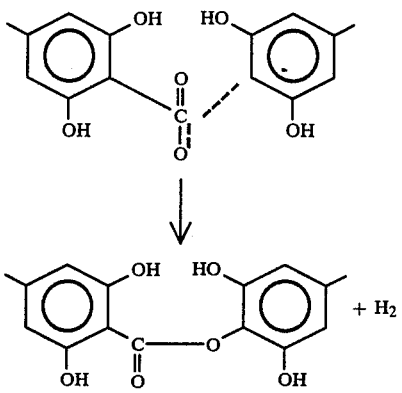

In the presence of divalent cations, e.g. Mg++ further bonding of an electrostatic character becomes possible, for example,

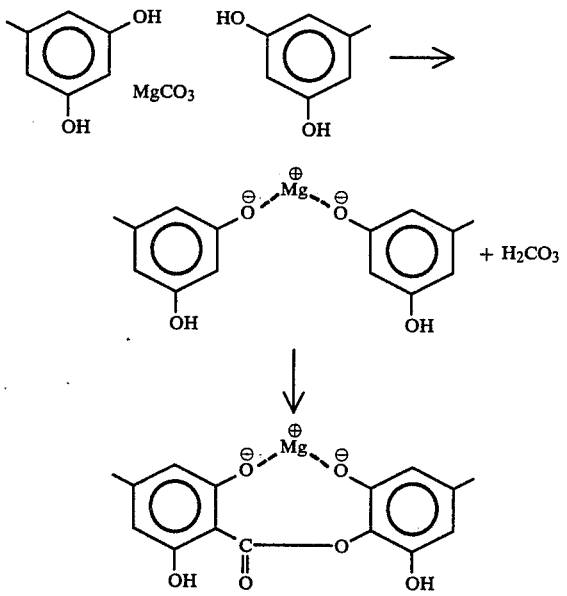

Bridging is now strengthened by the second form of bonding.

The bridge bonding mechanism confers a measure of flexibility on the system in that adjacent coal surfaces may bond without reaching the extremely close proximity required for direct bonding.

It will be clearly understood that the invention is not limited to the foregoing hypothetical discussion, which merely expresses our understanding of the most likely mechanisms at the present time. The benefits of the invention will be obtained by following the practical teachings herein, and persons skilled in the art will appreciate that modification of the underlying theory may occur in the light of subsequent knowledge without detracting in any way from the merits of the present invention.

In a preferred embodiment of the invention, in the first step raw brown coal with an 'as mined' water content of some 60% is subjected to attritioning in a blending or kneading machine/device or other device able to comminute the coal by shearing rather than by using other mechanism(s). In some instances it may be necessary to add up to some 5% of water to facilitate the attritioning process, however with freshly mined coal this is generally not necessary. The essential feature of this stage is that the microstructure of the coal is caused to be subjected to shearing stresses, typically in the case of, e.g., a Sigma blender, such stresses may be produced in a narrow gap between the walls of the blender and the rotating paddles. As mentioned the rupture of the microstructure is believed to expose many new surfaces which contain reactive constituents (such as phenols) able to form new covalent bonds under ambient conditions. The attritioning mechanism will also result in the comminution of the coal to fine particles, able to approach each other more closely thereby permitting inter-particle bonds to develop.

Under the conditions of particle size reduction by shearing, contamination of the newly cleaved surfaces is minimised and the surfaces thus retain maximum activity towards the formation of new bonds. By contrast, size reduction by abrasion against a steel (or other abradable surface) can result in severe contamination of the newly exposed coal faces and a "smearing over" of the disrupted coal structure. Accordingly reactivity of the surfaces will be constantly reduced as abrasion proceeds for longer periods.

Comminution of the microstructure of the raw coal apparently releases water originally contained within the pores and the development of a liquid water phase has been observed after about 1–1½ hours of attritioning. At this time the originally dry (in appearance) and friable coal assumes the form of a wet plastic mass. An appreciable temperature rise (up to 20° C.) is also observed to accompany this change. Most of this may be attributed to exothermic chemical reactions possibly involving atmospheric oxygen, and/or carbon dioxide. The temperature rise results in some loss of water by evaporation and condensation on cool adjacent surfaces.

The first step of the process can be regarded as completed when attritioning has proceeded far enough to yield a finely divided, smooth, wet plastic mass which will enable a densified coal of the required strength to be produced. The second step involves compaction of the wet plastic mass with formation of small pellets. In our experiments a quantity of such mass was extruded through a 10 mm diameter polymer tube attached to a piston-in-barrel device, but any suitable alternative extruding or compacting device may be used. Relatively modest extrusion pressures only are required since it is not the function of this stage to remove liquid water but rather to form the plastic material into a convenient physical, e.g. cylindrical, form and to improve the face-to-face packing and proximity to each other of the particles in the plastic mass.

It should be noted in this connection that higher extrusion pressures (produced in a device with a much narrower orifice) result in development of some bonding of the coal whilst still in the extruder. The resultant extruded mass is considerably harder and of lower water content than normal because part of the water has now become a separate phase. The higher pressures presumably force the coal particles sufficiently close to enable bridge bonding to be established between coal faces in proximity. Such higher pressures may be advantageous in circumstances where relatively high initial strength is required in the extruded material.

It is desirable to extrude the plasticised coal as soon as it is removed from the blending machine otherwise appreciable hardening may occur. If water loss is minimised and the plastic mass kept cool, hardening may be considerably delayed.

The extruded cylinder of coal may be cut into convenient lengths in preparation for the next, controlled, drying stage.

The relatively short time scale of the pellet drying process (in which water is removed from the subdivided mass) compared with solar drying of a large mass of material may be expected to lead to a beneficial reduction in the scale of the plant required.

After drying the product has a uniform vitreous appearance with no obvious shrinkage cracking. Its crush strength is relatively high and may substantially exceed that of pressed brown coal briquettes.

If temperatures during the drying become too high i.e. appreciably above ambient it appears that bonding about suitable nuclei proceeds rapidly and hard domains develop. The space midway between such domains then tends to become deprived of material and as water loss proceeds, shrinkage cracks develop in these regions. Poor crush strength follows.

On the other hand, under conditions of relatively slow hardening and slow water loss, bonding develops uniformly and shrinkage of the whole pellet takes place.

We would expect that the material would be suitable for stockpiling without serious self-heating or dusting characteristics which would further improve its acceptability as a fuel.

Brown coals are often distinguished by having low ash contents and the densified product will accordingly be relatively low in inorganic constituents. The densified product is therefore a useful and valuable starting material for the production by pyrolysis of exceedingly strong char and granular activated carbon.

EXAMPLE

Figure 2:
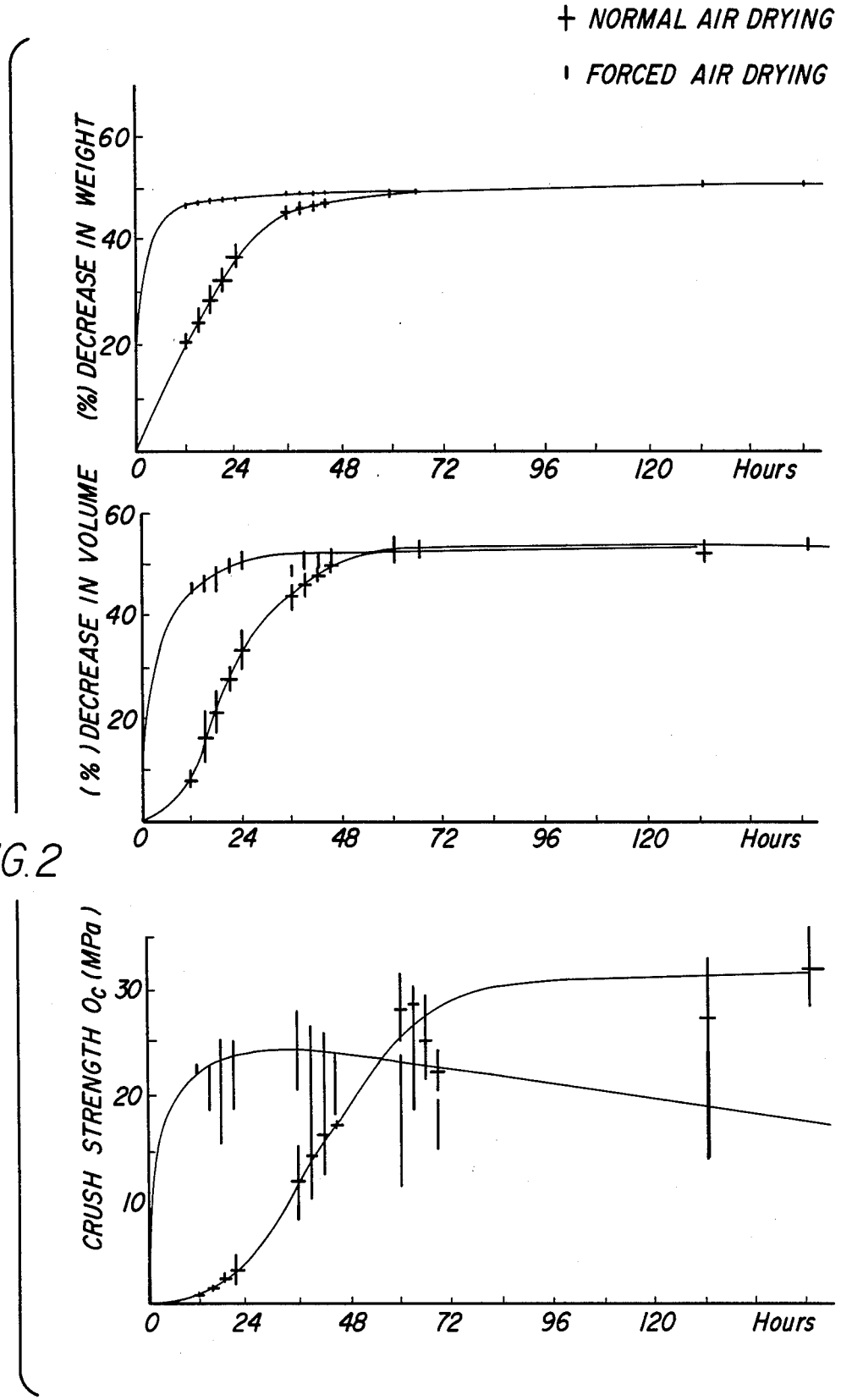

In the attached FIG. 2, three graphs illustrate in a quantitative manner how certain physical mechanical characteristics/properties in the upgraded product are achieved by the process of the invention.

These characteristics/properties are—

(i) percentage weight loss (water loss)

(ii) percentage volume decrease (iii) crush strength

Samples of brown coal were obtained from the Narracan deposit in the Latrobe Valley, Victoria, Australia. Experimental quantities of 400 g of this known coal, drawn from a much larger homogenised quantity, were subjected to attrition in a kneader for 5 hours to produce a smooth, wet plastic mass. The relative speeds of the two counter-rotating paddles of the kneader were in the ratio of 3:2 with a clearance of the order of 1 mm between the paddles and the blender box. The blender was actuated by a ½ h.p. motor. The mass produced was extruded and cut into convenient lengths some of which were permitted to stand exposed to the atmosphere at ambient temperature whilst the remaining ones were dried in a stream of air produced by an adjacent fan. The above mentioned characteristics/properties were measured at frequent intervals. The results are shown in FIG. 2.

It should be noted that there is a rapid spontaneous loss of water—in excess of 80% of the contained water in still air—after only 24 hours. The rate of loss is much more rapid when moving air displaces the evolved water vapour.

Crush strength develops somewhat more slowly in still air and reaches a maximum after 5–6 days.

Volume diminishes at about the same rate as crush strength increases.

Drying in moving air considerably enhances the rate of development of strength in the pellets.

The successful application of the drying and densification process to various brown coals (of differing lithotypes) from the Morwell, Loy Yang and Narracan deposits in the Latrobe Valley, Victoria, and also from the Madingley deposit at Bacchus Marsh in Victoria has been established.

Further useful applications of the novel product of the invention will be apparent to persons skilled in the art.

In essence the process described above involves three steps:

1. Firstly, there is an attritioning step in which the coal is subjected principally to shearing, as distinct from grinding forces. This is achieved in a blending or kneading apparatus or another machine able to comminute soft materials by shearing rather than by crushing or abrading.
2. The second step involves compaction of the wet plastic mass produced in the first stage by extrusion into pellets in an extruding or similar compacting device.
3. In the third stage of the aforementioned process the extruded pellets are dried at or near ambient temperature, preferably but not necessarilY with the assistance of some air flow to remove the water vapour evolved.

It is believed that a mechanism of chemical bridge bond formation is involved in the densification process. This centres on the irreversibility towards dispersion in water, changed behaviour towards solvent extraction, changes in pyrolysis behaviour, sensitivity of the process towards pH, and solute species in the aqueous medium, as well as marked changes in the spectral characteristics of the densified solids. All of these factors point towards the development of strong covalent and electrostatic bonds between the coal particles and, in particular, on these bonds involving small molecules and polyvalent ions forming bridges between reactive sites on adjacent faces of coal particles. An analogous, but not identical, situation for one of the types of bonding is that in which formaldehyde forms bridges between phenols in generating thermosetting phenol-formaldehyde resins.

Brief mention has been made above to the participation in the bonding process of molecular species in the coal structure with a natural acid ionization—typically phenols and/or carboxylic acids. The reactivity of covalent bonds in such species is dependent on the state of ionization of the acidic groups, which is diminished by increasing the acidity of the medium and vice versa.

We have found that alkali and alkaline earth carbonates (in spite of the comparative insolubility of the latter) have proved to be comparatively efficient additives to most coals for increasing the bonding strength. This suggests that, in addition to the alkalinity of these additives, the carbonate ion or an aqueous species derived from it plays a significant role in the bonding process. Possible species are those included in the following equilibria:

$$CO_3^{=} + HOH \rightleftharpoons HCO_3^{-} + OH^{-}$$

$$HCO_3^- + HOH \rightleftharpoons H_2CO_3 + OH^-$$

$$H_2CO_3 \rightleftharpoons CO_{2(aq.)} + HOH$$

Carbon dioxide is of course an invariable constituent of all coals, so that any effect due to added carbonate will be supplementary to that naturally present.

Of the known major chemical species in brown coals, as shown by pyrolysis-gas chromatography and other procedures, the phenols, and especially the polyhydroxy phenols, are likely to be the most reactive towards carbon dioxide or related molecular species at ordinary temperatures and pressures in an aqueous medium.

The reaction most likely to be significant is that in which carbon dioxide participates in electrophilic substitution at an activated position on the benzene ring of the phenol. The type of reaction is as below:

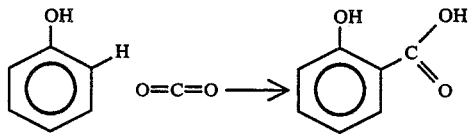

Pressure is required to achieve reaction with monohydroxy phenol, but when activation of ring positions is reinforced with two or three hydroxyls, as in the polyhydroxy phenols, then reaction will occur under ordinary conditions. The electron densities at various ring positions in hydroquinone, resorcinol and catechol illustrate this point.

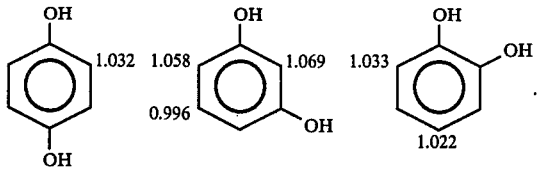

Of the three dihydroxy phenols, resorcinol is evidently the most reactive toward electrophilic substitution, with three positions having very high electron densities. Carboxylation with carbon dioxide yields the following two resorcylic acids:

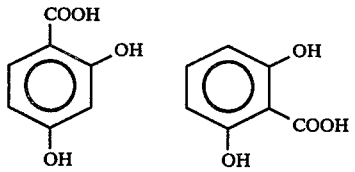

In general the electron densities at ring positions of the phenols are markedly influenced by the state of ionization of the hydroxyl groups. As the pH of the medium increases, the hydroxyls approach nearer to ionisation and the flow of electronic charge to the benzene ring will increase accordingly. Increase of pH will thus favour electrophilic substitution in suitable ring positions.

When the brown coal treated by the foregoing method is in its wet plastic state it consists of many small fragments dispersed in an aqueous phase, each fragment having freshly cleaved faces exposing phenols which will be attached to the main polymer framework of the coal. When coal faces are in close proximity, electrophilic substitution by carbon dioxide could well involve a pair of phenols, one in each face, giving a bridging structure rather than a carboxylic group attached to one ring only. The reaction may now be represented as follows:

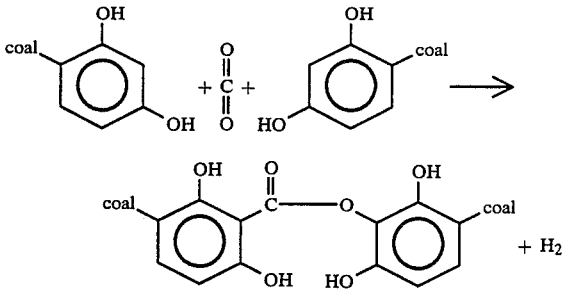

When coal faces are not close enough, reaction may still occur, but would be expected to result in inactivation of phenolic sites without achieving densification bonding.

There will always be sufficient carbon dioxide present in any coal to permit substantial reaction to proceed. The aqueous medium is important in the plastic state of the coal to facilitate the bridging bonding, in the manner of solvents in other chemical reactions.

It is an object of the present invention to enhance both the rate and extent of densification of brown coal. In one aspect the invention attains such enhancement by the careful selection and controlled use of additives. In a preferred embodiment the invention relates to the use of additives in upgrading brown coal treated in accordance with the process described above. The brown coal may also be upgraded by the process employing shorter treatment times as disclosed in our copending Australian provisional specification No. PG 9283, including a process in which the coal is subjected to shearing and extruding in a continuous manner, for example in a Sigma Knetmaschine HKS 50 manufactured by Janke and Kunkel GmbH and Co., KG IKA-Werk Biengen.

Our investigation has firmly established the usefulness of a wide range of additives, and their effectiveness in improving the rate and extent of densification as measured in terms of the crushing strength and attrition resistance of the densified material produced.

It must be noted that various brown coals show different responses to additives. These responses are related to the particular properties of the coals, the most important of which is probably the natural pH value of a given coal.

While the benefits obtainable from various additives about to be described are especially relevant to the brown coal upgrading process disclosed in our co-pending application, benefits may also be expected from such additives with other brown coal upgrading processes, e.g. a process such as that being investigated by the State Electricity Commission of Victoria, which involves the production of a pumpable coal slurry which is solar dried over several months.

Additives useful according to the present invention may generally be of the following types:

1. Additives for raising pH.
2. Additives for improving bridge bonding.
3. Additives which provide electrostatic bridge bonding capability in the form of divalent cations such as are present in magnesium and calcium compounds, for example according to the formula

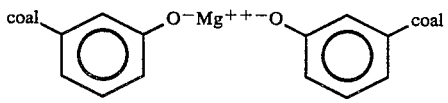

The addition of lime to peat during drying and briquetting is a well known practice. The present invention does not contemplate the use of lime as an additive.

Preferred additives are alkali metal hydroxides, ammonium hydroxide, alkali metal carbonates, the oxides of base metals and transition metals, aldehydes and certain carbonyl compounds.

We have found that alkali metal hydroxides, preferably in the range of 0.05 to 5% by weight, more preferably in the region of 2%, will significantly improve the strength and attrition resistance of densified brown coal pellets.

Ammonium hydroxide—a weak base—preferably in the range of 0.05 to 5.0% by weight, more preferably in the region of 0.5 to 2%, will have siimilar beneficial effects to alkali metal hydroxides. In this case not only is the acidity of the coal neutralized with the previously described advantages, but it is also possible that the aqueous ammonia phase provides an enhanced activity of those solute species, based on carbon dioxide, which function as bridging molecules between coal particles. This additive is especially advantageous in circumstances where the end use of the densified coal precludes the addition of metal ions. The use of an ammonia gas atmosphere during kneading of the coal is also very beneficial.

Alkali metal carbonates e.g. sodium carbonate have also been found to improve the rate of hardening, the crushing strength, and the attrition resistance of brown coal pellets, the percentages added being preferably 0.05 to 5.0% by weight, more preferably 1 to 2%. This additive has a twofold action in that it reduces the acidity of acid coals and also provides a considerably enhanced activity of aqueous species based on the carbonate ion, i.e.

$$CO_3^{=}+HOH=HCO_3+OH^-$$

$$HCO_3+HOH=H_2CO_3+OH^-$$

$$H_2CO_3=CO_2(aq.)+HOH$$

Alkaline earth hydroxides have a similar effect to the additives mentioned so far when added preferably at concentrations of 1 to 5% by weight. This also applies to alkaline earth carbonates (either precipitated or natural), in this case the concentration range being preferably 1 to 20% by weight.

Finely divided magnesium and calcium hydroxides are very effective additives with a twofold action. The pH of acid coals will be advantageously increased, while the divalent cations will form electrostatic bridge bonds, utilising acidic (including phenolic) groups on adjacent coal particles.

Finely ground natural magnesite and calcite, even though they are relatively insoluble, are still effective additives. Their functions include neutralisation of acids present in some coals, the provision of magnesium and calcium ions for electrostatic bridge bonding, and the provision of an additional supply of carbon dioxide species in solution.

Simple aldehydes and other small molecule carbonyl compounds in association with various bases have also been found to improve the rate of hardening, the strength and the attrition resistance of densified brown coal pellets, the concentration of additive preferably being in the range 1 to 5% by weight. The preferred aldehydes are formaldehyde and acetaldehyde, especially the former.

In this case, small molecule carbonyl compounds should be able to supplement carbon dioxide in providing bridging bonding between coal particles. Efficiency will be a function of pH, which determines the activity of polyhydroxy phenols towards electrophilic substitution.

Other useful carbonyl compounds are urea and formamide. Bases for use with these additives include the alkali hydroxides and ammonium hydroxide.

Hexamine (derived from formaldehyde and ammonium hydroxide) improves the rate of hardening, the strength, and attrition resistance of densified brown coal pellets, with addition rates preferably of 1 to 5%.

Hexamine, which yields ammonium hydroxide and formaldehyde slowly on hydrolysis, should provide both a neutralising action and a supply of bridging molecules:

$$6HCH+4NH_3=(CH_2)_6N_4+6H_2O$$

Base metals and transition metal oxides may also be used as additives in preferred concentration ranges of 5 to 70% by weight, yielding dried products which are often hard, dark, vitreous solids, and in some instances showing considerable increases in strength compared with the original coal.

Preferred embodiments of the invention will be illustrated by the following non-limiting examples, in which all percentages relate to dry weight:

EXAMPLE 1

(Alkali metal hydroxides)

Loy Yang medium-dark lithotype coal has a pH of 3.2 in the wet plastic state and might be expected to benefit particularly from base addition. Accordingly 200 g of this coal was subjected to attritioning for five hours in a sigma kneader with 2% (wt) of added sodium hydroxide. The resultant plastic mass (pH 5.7) was extruded in a hand operated screw extruder to produce 3 mm diameter rods which were cut in 5 mm lengths and permitted to dry for one week in still air at 20° C. Compressive strength measurements on the dried cylindrical pellets gave values averaging 48 MPa. By contrast, pellets made under identical conditions but without added sodium hydroxide yielded an average strength of 11 MPa.

Morwell coal has a natural pH of about 5.4. When treated experimentally as described above for Loy Yang coal with 2% sodium hydroxide addition, the resultant material hardened rapidly and became difficult to extrude. Repetition of the experiment with addition of 2% extra water and reduction of kneading time from 5 to 1.5 hours enabled pellets to be extruded which, when dried, gave an average compressive strength of 41 MPa. Pellets with no additive gave an average compressive strength of 29 MPa.

Maddingley coal has a natural pH of 7.1 and, when subjected to the experimental procedure described above for Loy Yang coal, produced pellets showing little improvement in compressive strength when compared with pellets containing no added sodium hydroxide.

EXAMPLE 2

(Ammonium hydroxide)

200 g of Loy Yang medium-dark lithotype coal (natural pH 3.2 in the wet plastic state) was subjected to attritioning for 5 hours in a sigma kneader, with 1% of aqueous ammonia (S.G. 0.880) as additive. The pH was increased by this treatment to 6.2. Pellets (10 mm diameter, 10 mm long) were then produced by extrusion with a hand screw extruder and dried in still air at 20° C. for one week. These pellets gave an average compressive strength of 35 MPa, in contrast to similar pellets made with no additive, for which the average was 5 MPa. Smaller pellets (3 mm, 5 mm long at extrusion) provided even greater compressive strengths, with an average of 63 MPa for material with 1% ammonium hydroxide additive. Similar pellets with no additive gave an average compressive strength of 11 MPa.

The enhanced compressive strength of smaller diameter pellets compared with that of larger diameter may be due to the considerably greater pressure developed in the extrusion device when the large diameter nozzle is replaced with that of a smaller diameter.

200 g of Morwell (N 3372, dark lithotype) coal of pH 4.0 had its pH increased to 7.6 on kneading in an atmosphere of ammonia gas. However hardening was very rapid, and the plastic mass became too stiff for successful extrusion. Considerable heat was developed in the kneading machine as work was performed, not only in breaking up the original coal structure but in destroying new structures formed as the densification processes proceeded rapidly.

EXAMPLE 3

(Alkali metal carbonates)

200 g of Loy Yang light lithotype coal (pH 3.4) was kneaded for 5 hours in a sigma kneader with an addition of 0.2% (wt) of sodium carbonate. The product was extruded in the hand operated screw extruder to provide 3 mm diameter pellets (5 mm long) which were air dried at 20° C. for one week. The average compressive strength of the pellets was 19 MPa, compared with an average of 11 MPa for pellets with no additive. For pellets produced under similar conditions with 0.4% $Na_2CO_3$ additive the average was 33 MPa.

Maddingley coal has a natural pH of about 7.1. When 3 mm diameter pellets were produced using the above experimental conditions but with 2% of added sodium carbonate, the average compressive strength was 38 MPa, compared with 29 MPa for pellets with no additive.

EXAMPLE 4

(Alkaline earth hydroxides)

200 g of Loy Yang medium-dark lithotype coal was kneaded in a sigma kneader for 5 hours with 5% by weight of fine precipitated magnesium hydroxide. The product was extruded in the hand operated screw extruder to yield 3 mm diameter, 5 mm long pellets which were dried in still air at 20° C. for one week. The average compressive strength was 61 MPa, compared with 11 MPa for similar pellets containing no additive. When calcium hydroxide was used as additive, average compressive strengths 39 and 65 MPa were found for pellets containing 2% and 5% calcium hydroxide.

EXAMPLE 5

(Alkaline earth carbonates)

200 g of Loy Yang medium-dark lithotype coal was kneaded in a sigma kneader for 5 hours with 5% by weight of fine magnesite. Extruded pellets (3×5 mm) when dried in still air at 20° C. for one week gave an average compressive strength of 20 Mpa. By contrast, similar pellets with no magnesite additive gave an average compressive strength of 11 MPa.

200 g of Morwell coal (H 1317 borehole, pH 4.6) was converted into 10 mm diameter (on extrusion) densified pellets by the above procedure. These pellets gave an average compressive strength of 23 Mpa. When similar pellets were prepared by kneading the coal with 20% of fine precipitated magnesium carbonate, the average compressive strength proved to be 36 MPa.

Similar experiments were performed with Morwell coal from the N 3372 borehole. In two separate experiments 5% each of fine magnesite and fine calcite were used as additives, and pellets of 10 mm diameter were extruded. The dried pellets in each case gave an average compressive strength of 39 MPa. By contrast similar pellets with no additive gave an average of 22 MPa.

EXAMPLE 6

(Formaldehyde and other simple aldehydes)

In the following experiments the preparative procedures described in the examples 1–5 above were used (that is, kneading, extrusion to produce pellets of either 3 or 10 mm diameter, followed by air drying).

Loy Yang medium-dark lithotype coal (pH 3.2) gave pellets of average compressive strength 5 and 11 MPa respectively for 10 mm and 3 mm pellets respectively. Addition of 2% sodium hydroxide during mixing increased these values to 18 and 48 MPa respectively. Further preparations in which 5% formaldehyde was added as well as 2% sodium hydroxide increased these values to 32 and 60 MPa respectively. The latter mixtures hardened very rapidly, and in some cases became impossible to extrude. These products assumed the form of very tough resinous solids.

When acetaldehyde was substituted for formaldehyde, the average compressive strengths were 22 and 51 MPa respectively for 10 mm and 3 mm pellets.

The neutral Maddingley coal (pH 7.1) did not require pH adjustment when aldehydes were used as additives. For example, with 1% of formaldehyde alone the average crush strength of 3 mm pellets was found to be 46 MPa, by contrast with 29 MPa for pellets with no additive.

An alternative measure of the strength of densified coals is provided by an attrition test in which a 5 g sample of pellets in 30 ml of water was tumbled 16,000 times in a 250 ml closed cylinder. Loy Yang medium-dark lithotype 3 mm pellets provided a recovery of only 9% of fragments exceeding 1 mm. With 2% sodium hydroxide additive, the recovery of fragments exceeding 1 mm increased to 81%, and with further addition of 5% formaldehyde the recovery increased to 96%. The corresponding values for Morwell coal were 79, 86 and 91%.

EXAMPLE 7

(Hexamine)

The reagent hexamine yields ammonium hydroxide and formaldehyde slowly on hydrolysis, and should therefore provide both a neutralising action and a supply of bridging molecules. Experiments were performed with Loy Yang medium-dark coal using the procedures detailed in Examples 1 to 6 above, with 5% hexamine as additive. The additive caused an increase in pH of the mixtures from 3.2 to 5.1, and in the average compressive strength of the 3 mm pellets from 11 to 29 MPa. The attrition resistance of the densified pellets was also much improved, from a 9% recovery of fragments exceeding 1 mm to a 68% recovery.

EXAMPLE 8

(Base metal and transition metal oxides)

It has proved possible to incorporate quite high proportions of certain finely divided metal oxides in brown coals during the densification procedures as detailed in Examples 1 to 7 above. The dried products are often hard, dark, vitreous solids, and in some instances show considerable increases in strength compared with the original coal.

Morwell (N 3372) coal (pH 3.8) with 20% of additional water provided 10 mm diameter pellets of compressive strength about 21 MPa. With 10% cobalt oxide the strength increased to about 25 MPa, which increased further to about 31 MPa on pyrolysis to 500° C. in an inert atmosphere. The coal alone does not show an increase in strength on pyrolysis.

Loy Yang (dark) coal (pH 3.2) provided 3 mm diameter pellets of compressive strength about 11 MPa. With 10% CuO the dry pellets gave a compressive strength of about 47 MPa.

Loy Yang (dark) coal with 10% fine $Fe_2O_3$ provided compressive strengths of about 22 MPa (3 mm diameter pellets). Further preparations containing 30, 50 and 75% $Fe_2O_3$ all provided hard coherent pellets, indicating that bonding was still effective in spite of the large proportions of inorganic material.

It will be clearly understood that the invention in its general aspects is not limited to the specific details referred to hereinabove.

What is claimed is:

1. Process for production of densified coal pellets of improved physical properties which includes subjecting brown coal to a shearing-attritioning step followed by extrusion and drying, characterised by incorporating an additive into the coal that is subject to the said shearing-attritioning step, said additive being chosen from one or more of the group consisting of:

alkaline earth metal hydroxides,
ammonium hydroxide,
oxides of base metals, and
oxides of transition metals.

2. Process according to claim 1 in which the additive comprises aqueous ammonia, added to the coal in an amount of 0.05 to 5% of 0.880 ammonia per dry weight of coal.

3. Process according to claim 2 in which the amount of 0.880 ammonia used is from 0.05 to 2%.

4. Process according to claim 1 in which the additive comprises an alkaline earth hydroxide used in an amount of 1 to 5% based on the dry weight of the coal.

5. Process according to claim 4 in which the additive comprises finely divided magnesium hydroxide and/or calcium hydroxide.

6. Process according to claim 1 in which the additive comprises acetaldehyde used in an amount of 1 to 5% based on the dry weight of the coal.

7. Process according to claim 1 in which the additive comprises urea and/or formamide used together with one or more alkali metal hydroxides and/or ammonia.

8. Process according to claim 1 in which the additive comprises hexamine.

9. Process according to claim 1 in which the additive is chosen from base metal oxides and/or transition metal oxides used in an amount of 5 to 70% based on the dry weight of the coal.

10. In a process for treatment of brown coal which comprises subjecting the said brown coal to shearing forces to produce a wet plastic mass which is capable of conversion by subsequent compaction and drying into a fuel of increased and enhanced calorific value, the improvement which comprises effecting said step of subjecting the brown coal to shearing forces in the presence of an additive which enhances the bonding between sheared coal particles in said mass.

11. A process according to claim 10 wherein said additive is selected from the group consisting of carbon dioxide, sodium carbonate, magnesium carbonate, calcium carbonate and small molecule organic compounds.

12. A process according to claim 10 wherein said additive is selected from the group consisting of alkali metal carbonates and alkaline earth carbonates.

13. A process according to claim 12 wherein said additive comprises an alkali metal carbonate.

14. A process according to calim 12 in which the additive comprises an alkaline earth carbonate.

15. A process according to claim 10 in which the additive comprises finely divided magnesite or calcite.

16. A process according to claim 10 wherein said additive comprises formaldehyde.

* * * * *